United States Patent [19]

Rockerath et al.

[11] Patent Number: 4,877,655

[45] Date of Patent: Oct. 31, 1989

[54] BALL HOLDING AND CEMENTING APPARATUS AND METHOD

[75] Inventors: John L. Rockerath, Whitesboro, N.Y.; Dale K. Blust, Atco, N.J.

[73] Assignee: Figgie International Inc., Willoughby, Ohio

[21] Appl. No.: 73,819

[22] Filed: Jul. 15, 1987

[51] Int. Cl.[4] ..... B05D 1/18

[52] U.S. Cl. ..... 427/430.1; 118/421; 118/423; 118/428; 118/500; 118/502; 414/626

[58] Field of Search ..... 294/902, 166; 224/919; 118/500, 502, 428, 421, 423; 427/430.1; 414/626

[56] References Cited

U.S. PATENT DOCUMENTS

| | | | |
|---|---|---|---|
| 229,544 | 7/1880 | Maynard | 118/502 |
| 309,243 | 12/1884 | Patch | 118/502 |
| 1,238,619 | 8/1917 | Anderson | 118/56 |
| 1,258,071 | 3/1918 | Winter | 118/421 X |
| 1,327,273 | 1/1920 | Eskilson | 118/52 |
| 1,333,006 | 3/1920 | Welser | 198/377 |
| 1,366,188 | 1/1921 | Kirino . | |
| 1,608,293 | 11/1926 | Beebe | 118/502 |
| 1,622,855 | 3/1927 | Warner | 118/56 |
| 1,714,994 | 5/1929 | Turner . | |
| 1,733,192 | 10/1929 | Haber | 134/61 |
| 1,796,820 | 3/1931 | Adams | 118/54 |
| 1,840,008 | 1/1932 | Ault | 156/538 |
| 1,961,301 | 6/1934 | Nier | 91/42 |
| 2,120,171 | 6/1938 | Bialy | 20/70 |
| 2,122,052 | 6/1938 | Bell | 198/199 |
| 2,556,744 | 6/1951 | Walrath | 118/503 |
| 2,615,455 | 10/1952 | Persson | 134/58 |
| 2,647,282 | 8/1953 | Schroeder | 18/27 |
| 2,667,138 | 1/1954 | Maher | 113/93 |
| 2,695,595 | 11/1954 | Hagerman | 118/502 |
| 2,822,843 | 2/1958 | Morici | 146/52 |
| 2,857,878 | 10/1958 | Matson et al. | 118/421 |
| 2,864,281 | 12/1958 | Draper | 88/14.8 |
| 2,884,897 | 5/1959 | Richeson | 118/315 |
| 2,958,308 | 11/1960 | Pikal | 118/16 |
| 3,147,847 | 9/1964 | Miller | 198/131 |
| 3,310,027 | 3/1967 | Lindemann | 118/52 |
| 3,374,903 | 3/1968 | Glover | 214/6 |
| 3,447,707 | 6/1969 | Furst | 214/307 |
| 3,633,540 | 1/1972 | Bolt | 118/502 |
| 3,827,400 | 8/1974 | Grenfell | 118/421 |
| 3,830,152 | 8/1974 | Reed | 99/643 |
| 3,847,070 | 11/1974 | Draggett | 99/643 |
| 4,072,256 | 2/1978 | Young | 294/166 X |
| 4,096,295 | 6/1978 | Marks | 427/209 |
| 4,113,165 | 9/1978 | Ott | 118/421 X |
| 4,314,524 | 2/1982 | Deguchi | 118/54 |
| 4,597,931 | 7/1986 | Watanabe et al. | 118/421 X |

*Primary Examiner*—Shrive Beck

*Attorney, Agent, or Firm*—Thomas A. Lennox

[57] ABSTRACT

A holder and cementing apparatus for string wound baseball cores includes six vertically downwardly depending tines arranged in a circular pattern to allow the ball to be wedged between the tines with an ejector pin moved upwardly by engagement of the ball and later forced downwardly to eject the ball with the holder supported on a trolley moving along horizontal guides from a first station where the ball is pushed upwardly by a supporting member into the ball holder to a second position inside an enclosure over a coating liquid supply where a cup is raised from below the level of the liquid to immerse the ball in the cup's liquid with movable side panels that open and close to allow the ball to enter the enclosure and to protect from liquid splatter when the ball is rotated at a high rate of speed to remove excess liquid followed by movement out of these openings to a destination station where a ball is sensed to insure proper operation.

23 Claims, 6 Drawing Sheets

HT
d
Δp
t
A
B
C
D
D'
E
F
62
63
68
69

R
t
A
B
C
D
D'
E
F
60
61

BALL HOLDING AND CEMENTING APPARATUS AND METHOD

BACKGROUND OF THE INVENTION

This invention involves a holder of objects, specifically rounded objects, such as spheres particularly string wound baseballs and a coating apparatus to coat objects using a bath of the coating liquid.

A variety of devices have been used to hold objects with many of the devices and methods described for handling fruit, such as apples, peaches, oranges and like fruit generally of a spherical shape. In the handling of fruit and for the handling of others objects such as string wound baseball cores, a single or multiple pin stabbing device may be used to impale the object and hold it while some type of action is applied to the object, such as coating the object with a liquid as with a cement. These stabbing devices have been single pins or multiple pins grouped to pierce the object at a central location.

In applying a coating to a single object, such as continuous processes have been described. For coating a string wound baseball with a cement to hold the strings in place, few if any continuous processes have been described, but it is known that a continuous coating process may utilize a chain drive to carrying ball holders from station to station with a spinning mechanism to spin the holders after the coating has been applied to remove any excess liquid. These would be large, cumbersome devices which provide a large through-put, but many suffer from mechanical failure and substantial maintenance difficulties.

The above devices and methods do not satisfy the needs in the industry to provide a compact efficient coating apparatus including a holder of the objects to be coated nor do these devices attain the objects listed herein below.

SUMMARY OF THE INVENTION

In utilizing a stabbing mechanism including two or three stabbing pins which enter the string wound baseball at a central location, the problem of a "string tail" has been observed. In the production of baseballs using hand operations, the baseballs are tumbled in a drum containing the cement coating, are removed, from the drum and excess liquid removed by running the balls down a ramp or by some spinning method. Long tails of string sometimes hang from the balls after the tumbling operation and during the removal of the excess liquid. The same problem of "tails" occurs when the balls are held during the cement coating and spinning operations using a stabber entering a central location. The end of the string is free to unravel until the string passes between the central stabbing pins. The string can unravel to a length of many feet requiring it to be rewound onto the ball by hand which is cumbersome and messy task. The invention is a holder for objects including a base member and a plurality of at least three tines structurally attached and projecting from the base member spaced apart around a periphery of a cross sectional area of a plane cut through the object, the tines being of sufficient size and composition that the object can be forced into the area between the tines.

It is preferred that the holder be for spherical balls, such as string wound balls so that the tines are located on a circle slightly smaller than the circumference of the balls. The preferred number of tines is four to ten, more preferably the number of tines is six. It is preferred that the holding device include an object support device to support the object in a set position and a support movement device to move the object support device toward the tines to wedge the object between the tines. A preferred object support device is ring of sufficient size to allow the object to seat in a set position. A preferred support member device includes a vertical piston rod attached to the object support device and rod movement device to move the object support device upwardly to wedge the object in downwardly depending tines. A preferred holder includes an ejector member extending from the base member in the same direction as the tines, the ejector member being slidably connected to the base member to move in a direction away from the object as the object is wedged between the tines. It is preferred to include an ejector member movement device to move the ejector member against the object to dislodge the object from between the tines.

The invention includes a method for holding objects including supporting a base member, structurally attaching a plurality of at least three tines projecting from the base member spaced apart around a periphery of a cross sectional area of a plane cut through the object, and wedging the object into the area between the tines. A preferred method includes moving the object vertically upwardly to wedge the object in downwardly depending tines, slidably connecting an ejector member extending to the base member in the same direction as to the tines to move in a direction away from the object as the object is wedged between the tines, and moving the ejector member against the object to dislodge the object from between the tines.

The invention includes an apparatus to coat an object with a liquid including a tank containing a supply of the coating liquid with a surface and an object holding device to hold the object over the surface of the liquid. A container is provided having a top opening of sufficient size to allow the object to pass through and an internal height of a distance greater than the height of the object as it is held in the object holding device. The apparatus further includes a container movement device to submerge the container in the liquid and move the container upwardly to immerse the object in the liquid in the container. A preferred apparatus includes a carriage body to which the object holding device is attached, and a track movement device to move the carriage body along a path to a position over the liquid surface. A preferred apparatus includes an enclosure device to enclose a space over the liquid surface including first and second vertical walls with openings of sufficient size to allow the object holding device and the object to enter and leave the enclosure. A pair of panels at least as large in area as the openings are positioned to abut the inside surface of and the openings through the first and second vertical walls with a wall movement device to lower the panels a sufficient distance to allow the object holding device and the object to be moved in and out of the enclosure. It is preferred that the apparatus further include a spinning device to spin the object holding device in the space over the liquid surface at sufficient rate of rotation to remove any excess liquid from the object.

A method of the invention to coat an object with a liquid includes filling a tank with a supply of the coating liquid with a surface and holding the object over the surface of the liquid. The method continues providing a container having a top opening of sufficient size to allow the object to pass through and at an internal height of a distance greater than the height of the object as it is held in the object holding device and submerging the container in the liquid. The method concludes by moving the container upwardly to immerse the object in the liquid in the container. A preferred method includes holding the object to a carriage body and moving the carriage body along a path to a position over the liquid surface. It is preferred that the method further includes enclosing a space over the liquid surface with an enclosure including first and second vertical walls, and lowering the first and second vertical walls a sufficient distance to allow moving the carriage body and the object in and out of the enclosure device. A preferred method includes spinning the object in the space over the liquid surface of sufficient rate of rotation to remove any excess liquid from the object.

It is an object of the present invention to provide a holding device which will allow wedging or spherical or at least generally spherical objects by the use of tines that need not penetrate the surface of the object. The tines may be formed of a shape such that they allow the length of the tines to hold the object between them without penetrating the object.

It is a further object of the present invention to provide a holder for string wound baseballs wherein a plurality of tines surround the ball at its periphery or penetrate slightly into the surface for merely allow the ball to be wedged between the tines.

It is a specific object of the present invention to provide a sufficient number of tines to surround the periphery of a string wound baseball core such that the end of the string may unwind only a few inches until a winding passes under a tine and the upper hemisphere of the ball such that further unwinding of the string is difficult without purposefully pulling the string from around the tines.

It is a further object of the present invention to provide a holder which allows for spinning of the holder with the object held in position without having to disengage any connecting apparatus to the holder.

It is an additional object of the present invention to provide a holding device which allows for ejection of the object from the holder with ease and simplicity.

It is a particular object of the present invention to provide a holder which may be held in a stationery position in relation to the direction of entry of the object toward the holder as the object is wedged into the holding device.

It is a specific object of the present invention to provide a holder capable of being spun and be in continuous engagement with the spinning mechanism while the ball is being first held by an apparatus, while the object is being coated and finally when the object is being spun to remove excess liquid.

It is a specific object of the present invention to provide a mechanism by which an object to be coated may be held in a stationery position and be coated by dipping the object under the surface of a liquid.

It is a particular object of the present invention to provide an apparatus which will allow movement of an object to be coated under an enclosure above a liquid surface coating that object and spinning the object to remove excess without loss of liquid to the surrounding area and then move the object out of the enclosure to dispense the ball.

It is a specific object of the present invention to provide an apparatus which provides for movement of a holding device capable of holding an object to which coating is to be applied wherein the movement of the object holding device is along a single straight line during which the object is engaged into the holding device, the object is dip coated, the object is spun to remove excess liquid and is moved to a destination.

The above objects are attained by the apparatus and methods described herein above.

DESCRIPTION OF PREFERRED EMBODIMENTS

A preferred holder for objects includes a base member and a plurality of at least three tines structurally attached and projecting from the base member spaced apart around a periphery of a cross sectional area of a plane cut through the object, the tines being of sufficient size and composition that the object can be forced into the area between the tines. An object support device to support the object in a set position is provided together with a support movement device to move the object support device toward the tines to wedge the object between the tines including a vertical piston rod attached to the object support device and rod movement device to move the object support device upwardly to wedge the object in downwardly depending tines. An ejector member is provided extending from the base member in the same direction as the tines slidably connected to the base member to move in a direction away from the object as it is wedged between the tines, together with an ejector member movement device to move the ejector member against the object to dislodge it from between the tines.

A preferred apparatus to coat an object with a liquid includes a carriage body, an object holding device attached to the carriage body to hold the object and a tank containing a supply of coating liquid with a surface. A track movement device is provided to move the carriage body along a path to a position over the liquid surface with an enclosure device to enclose a space over the liquid surface including first and second vertical walls. It is preferred that the apparatus further include a spinning device to spin the object holding device in the space over the liquid surface at sufficient rate of rotation to remove any excess liquid from the object. A preferred apparatus includes a container having a top opening of sufficient size to allow the object to pass through and an internal height of a distance greater than the height of the object as it is held in the object holding device, and a container movement device to submerge the container in the liquid and move the container upwardly to immerse the object in the liquid in the container.

A preferred method to coat an object with a liquid includes holding an object to a carriage body, filling a tank with a supply of coating liquid with a surface and moving the carriage body along a path to a position over the liquid surface. The method continues by enclosing with an enclosure a space over the liquid surface including first and second vertical walls, lowering the first and second vertical walls a sufficient distance to allow moving the carriage body and the object in and out of the enclosure device, and coating the object with the liquid from the tank.

Figure 1:
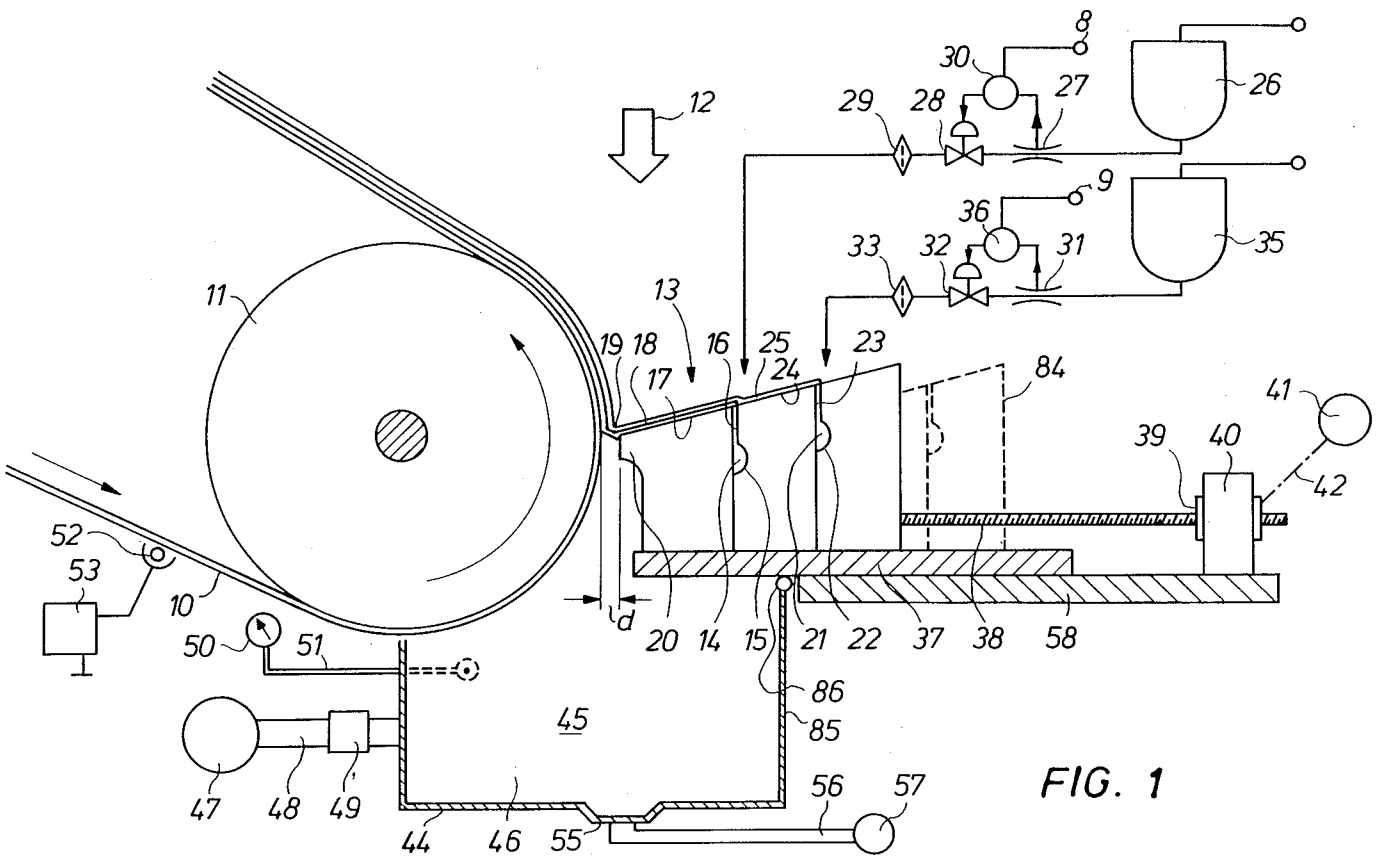
FIG. 1 is a perspective view of a holding device and cementing apparatus of the present invention.

In FIG. 1 ball holding device 10 is shown as part of coating apparatus 12. A shadow view of ball 14 is illustrated resting on ball support 16 which includes entrance groove 18 providing a continuation of a ramp from which ball 14 rolls down guided by stop pins 20 into cup shaped depression 22. Ball support 16 is supported on piston rod 25 (hidden here) which is actuated by air cylinder 24 attached to base member 32. Cylinder 24, which upon receiving a signal raises platform ball support 16 vertically upwardly to wedge ball 14 into ball holding device 10. Ball holding device 10 includes six pins 26 depending downwardly and structurally attached to base member 28. The spacing of pins 26 are essentially on a circumference of a circular area equal to the largest cross sectional area of ball 14. Since ball 14 is a string wound ball core, pins 26 will spring outwardly to allow ball 14 to wedge in between the pins. It is quite satisfactory if one or more of the pins slightly pierce the outer strings of the ball although that is not necessary to hold the ball in position. Base member 28 is structurally attached to shaft 100 (hidden in this view) supported on bearing/connector 34 which attached to trolley platform 36. Shaft 100 from base member 32 extends upwardly through a hole in platform 36 and is structurally attached to shaft pulley 38 driven by rubber belt 40 engaged in drive pulley 42 driven through a central shaft by electric motor 44. Air cylinder 46 is supported by table 48 which holds the end of ejector rod 101 (hidden in this view) which slides up and down in a lengthwise bore the length of a shaft 100. Platform 36 rides on four bearings 50 located at its four corners depending downwardly below the platform and riding on front circular rod guide 52 and rear circular guide 54, both supported horizontally at their ends by support member 56 at the end closest ball holder 16 and at the other end by support member 58. Platform 36 is pulled back and forth along horizontal guide members 52 and 54 by TOL-O-MATIC RS series cable cylinder 60 model ( RS S-100-1 cable cylinder) available commercially from Tol-O-Matic, 1028 South Third Street, Minneapolis, Minn. 55415 which is driven by air pressure which includes a reverse loop cable inside the cylinder capable of precise movement of platform 36 to any of three positions. As illustrated in FIG. 1, platform 36 is in the first position at the start of the use of the apparatus positioning ball holding device 10 directly over ball holder 16. When platform 36 is moved by cable cylinder 60 to the intermediate position positioning ball holding device 10 directly over coating tank 62, guide member 64 will be positioned directly in front of locking pin 66 driven by air cylinder 68 into a hole in the back of guide member 64 corresponding in size to closely interfit with locking pin 66 thus locking platform 36 in position during the spinning cycle. When platform 36 is moved by cable cylinder 60 to the far end of guide members 52 and 54, the edge of platform 36 engages flexible bumper 70 to prevent striking stop members 72 too hard. In that far last position, ball holder 10 is holding ball 14 in between sensors 74 which are positioned by "Y" shaped horizontal support member 76 on opposite sides of the ball to register whether a ball is in position at that point. Should a ball not be present at that stage of operation, the system must shut down as a ball must be lost in the coating tank. Coating tank 62 includes a lower liquid tank 78 in which a substantial supply of liquid coating, in this case cement, is stored. Above tank 68 is enclosure 80 which includes front vertical wall 82, rear vertical wall 84 (hidden in this view), first side wall 86 and second side wall 88. First side wall 86 faces ball support 16 and has cut out opening 90 of a sufficient size to allow ball holding device 10, shaft 100, and ball 14 to move through the opening to the interior space of enclosure 80. Movable panel 92 is just visable on the inside of wall 86 and abutting the interior surface of wall 86. In this position, movable panel 92 is in its downward position providing no obstruction through opening 90 to allow ball 14 to ride on platform 36 into the interior space of enclosure 80. Enclosure 80 also includes top cover 89 to essentially completely enclose the space.

Figure 2:
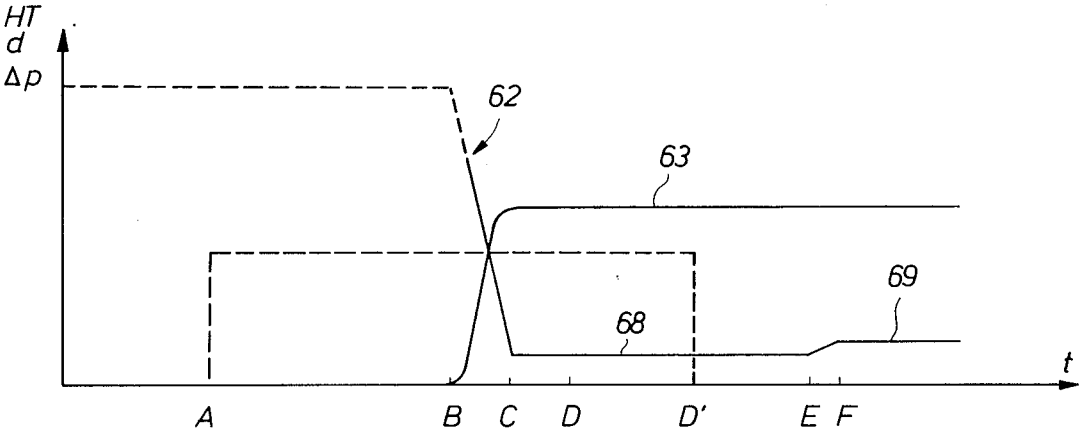
FIG. 2 is a vertical cross sectional view taken along lines 2—2 of FIG. 1.

FIG. 2 is a vertical cross sectional view showing the internal mechanisms inside tank 62 and enclosure 80 as well as the relationships at the first station where ball 14 is held in ball holding device 10 wedged between tines 26. As ball 14 is wedged in, it pushes ejector pin 101 upwardly inside hollow cylindrical shaft 100 which rides in bearings 34 attached to platform 36. At the upper end of ejector pin 101 is attached air cylinder 46 supported on table 48 which drives ejector pin 101 downwardly to move ball 14 out of the grips of tines 26 to dispense the ball after the operation of apparatus 12. In this view a different perspective is provided of motor 44 turning drive pulley 42 in which belt 40 is engaged around shaft pulley 38 to spin shaft 100, ball holding device 10 and ball 14' while inside enclosure 80. Also shown at the first station, is support member 16 holding a shadow view designated ball 14' resting in circular cut out cup depression 22. Ball 14' is also shown rolling down ramp 15 toward and along groove 18 to cup depression 22. Air cylinder 24 raises piston rod 25 that is structurally attached to support holder 16 forcing ball 14' up to position 14 wedging the ball between tines 26 and pushing ejector pin 101 upwardly. Shadow views of the movement of the device along the path of guide rod 52 by cable cylinder 60 illustrates the three positions of platform 36. The second position and intermediate position places platform 36 over enclosure 80 and tank system 62 with ball holder 10 and ball 14, now positioned as 14', in the space of enclosure 80 over liquid 116 in tank 78. After moving platform 36 to this position, air cylinder 114 is actuated raising piston rod 112 upwardly which is structurally supporting cup 108 having interior dimensions 110 sufficient to allow cup 108 to completely surround ball 14' and not engage ball holding device 10. As cup 108 is raised from below liquid 116 above liquid surface level 118, cup 108 is full of liquid and as it surrounds ball 14' and ball 14' is dip coated. After coating, cylinder 114 lowers piston rod 112 and cup 108 below liquid surface level 118 to refill. In this view, movable panels 92 and 96 are in the lowered position allowing ball holding device 10 and ball 14 to be moved through opening 90 into the space of enclosure 80. After cup 108 is lowered, air cylinder 106 actuates and pushes piston rod 102 upwardly moving lever 104 which is structurally attached at its other end to pivot rod 98 supported and rotating in connector bearings 97 and 99 which are fixed to walls 88 and 86 respectively. As piston rod 102 is raised, lever 104 is raised at the end connected to the piston rod which in turn raises panels 92 and 96 upperwardly to cover cut out openings 90 and 94. At that stage, motor 44 spins shaft 100, ball holding device 10 and ball 14' to throw excess liquid outwardly to the sides of the tank and specifically against panels 92 and 96 which catch the liquid and allow it to drain back into liquid supply 116. After spinning, piston rod 102 is lowered turning pivot rod 98 and lowering panels 92 and 96 back into the liquid in tank 78. Cable cylinder 60 then moves platform 36 to the last and final destination position abutting support member 58 placing the ball, now designated 14' still held in ball holding device 10 between the sensors held in support member 76. At that point, air cylinder 46 drives ejector pin 101 downwardly to push ball 14' out of engagement of pins 26 to the destination station.

Figure 3:
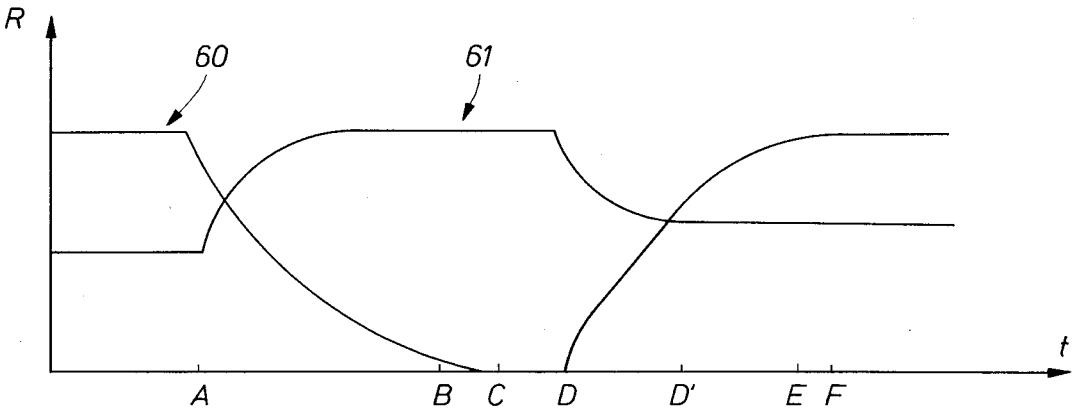
FIG. 3 is an expanded perspective view of a holding device of the present invention.

A close up of ball holding device 10 is illustrated in FIG. 3 held on vertical tubular shaft 100 within which ejector pin 101 rides up and down. Base member 28 includes six downwardly depending members into which stainless spring steel tines 26 are fixed the points of tines 26 being arranged in a circular pattern of a size equal to the equatorial circumference of ball 14. Tines 26 are equally spaced and may number any reasonable number although six tines is an effective number to provide a very short "tails" and yet disrupt the coating process as little as possible. Tines 26 are pointed, but need not be particularly sharp since penetration of the ball is not required. Typically one or more of the tines will engage the ball under a string or two at the edge. The tines may be formed outwardly from the ball surface to reduce the tendency to penetrate the ball surface with the ball still being securely held between the body of the tines.

Figure 4:
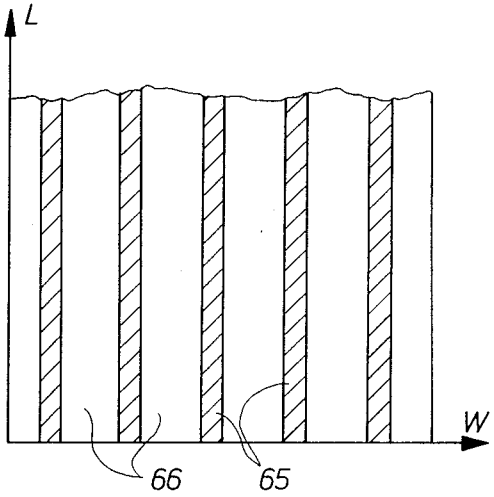
FIG. 4 is a perspective view of the device and apparatus of FIG. 1 wherein the ball holding device has been moved above the liquid in the enclosure.

In FIG. 4, platform 36 has been moved to the intermediate position moving ball holding device 10 through opening 90 into the interior of enclosure 90 holding ball 14 over the liquid level ready to be coated. Second vertical wall 88 furthest from ball support 16, also has opening 94 cut out large enough to allow ball holding device 10, shaft 100 and ball 14 to ultimately pass out of enclosure 80 to the final destination position. Movable panel 96 is just visible in this view lowered to its lowest position so that opening 94 is unobstructed. Actually, movable panels 96 and 92 both move concurrently on one pivot rod 98 (hidden here behind guide 52), as separate mechanisms are not necessary as panels 92 and 96 are only in their upward position during the spin cycle. In the spin cycle, air cylinder 68 has now actuated locking pin 66 into guide member 64 to hold platform 36 securely in position.

Figure 5:
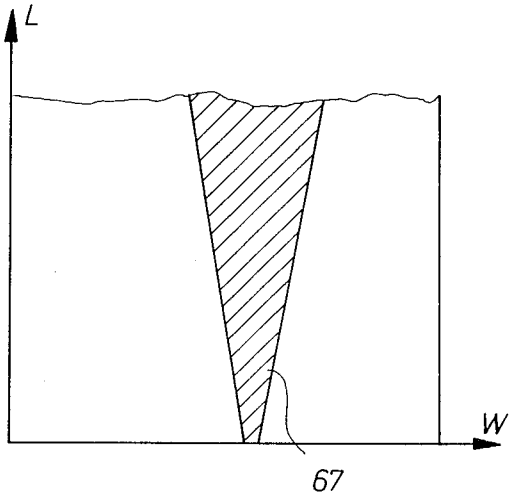
FIG. 5 is a partially cut away perspective view of the device and apparatus illustrated in FIG. 1 with the enclosure in a closed position.

In FIG. 5, enclosure 80 is now completely closed up with additional rear top cover 91 in position to cover the enclosure from the rear and movable panel 92 (as well as movable panel 96) have been moved upwardly to provide a splash guard covering cut out 90 by actuation of piston rod 102 moving lever 104 that is structurally attached at the other end to pivot rod 98 which is structurally attached to panels 92 and 96. In this cycle, motor 44 drives pulley 42 and belt 40 engaged in shaft pulley 38 which turns shaft 100 and ball holding device 10 inside enclosure 80 at a speed sufficient to remove excess liquid.

Figure 6:
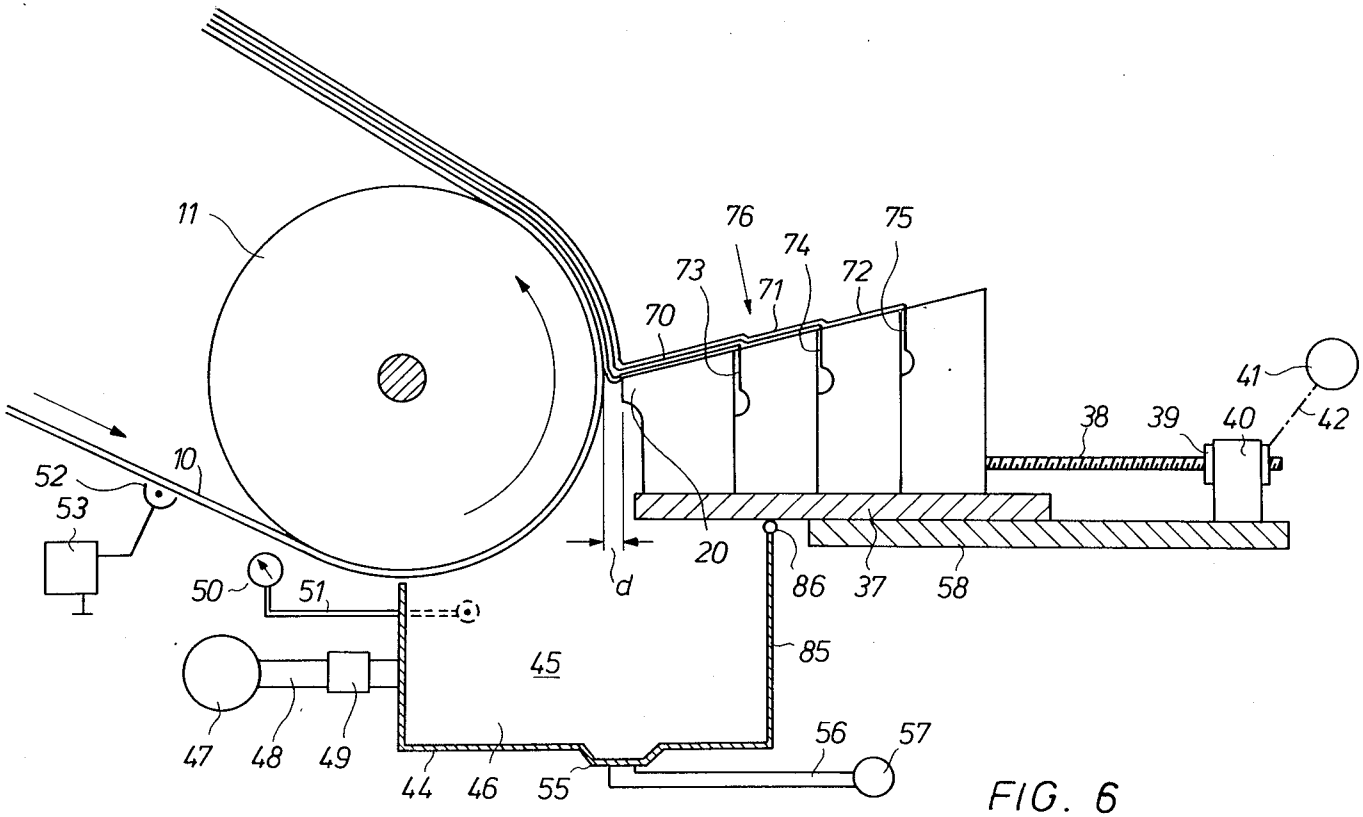
FIG. 6 is a cross-sectional view taken along lines 6—6 of FIG. 5.

In FIG. 6, the positions and movement of panel 92 (and likewise panel 96 not shown here) are illustrated. In this view, panel 92 is in its downward position 92' having pivoted downwardly by pulling downwardly on rod 102' to pull down lever 104' and panel 92' on pivot rod 98 which is supported on connector bearing 99 on wall 86 of enclosure 80. When the spinning process is to be started, panel 92' is rotated upwardly on pivot rod 98 to position 92 by pushing upwardly on rod 102 moving lever 102 and panel 92 to completely cover opening 90 which has allowed ball support device 10 and ball 14'' to be moved on platform 36 inside the space of enclosure 80. The spinning process is attained by rotating drive pulley 42 engaged with belt 40 which is in turn around shaft pulley 48 which spins shaft 100, ball holding device 10 and ball 14' inside enclosure 80. To fix platform 36 in a rigid position during the spin process, air cylinder 68 drives piston rod locking pin 66 into the female corresponding cavity of guide member 64 to hold the structure in position during the spin cycle. After the spin cycle has been completed, panel 92' is rotated downwardly to position 92 so that platform 36 may ride along guide members 52 and 54 moving ball holding device 10 through opening 94 out of the space of enclosure 80 to the destination station.

Figure 7:
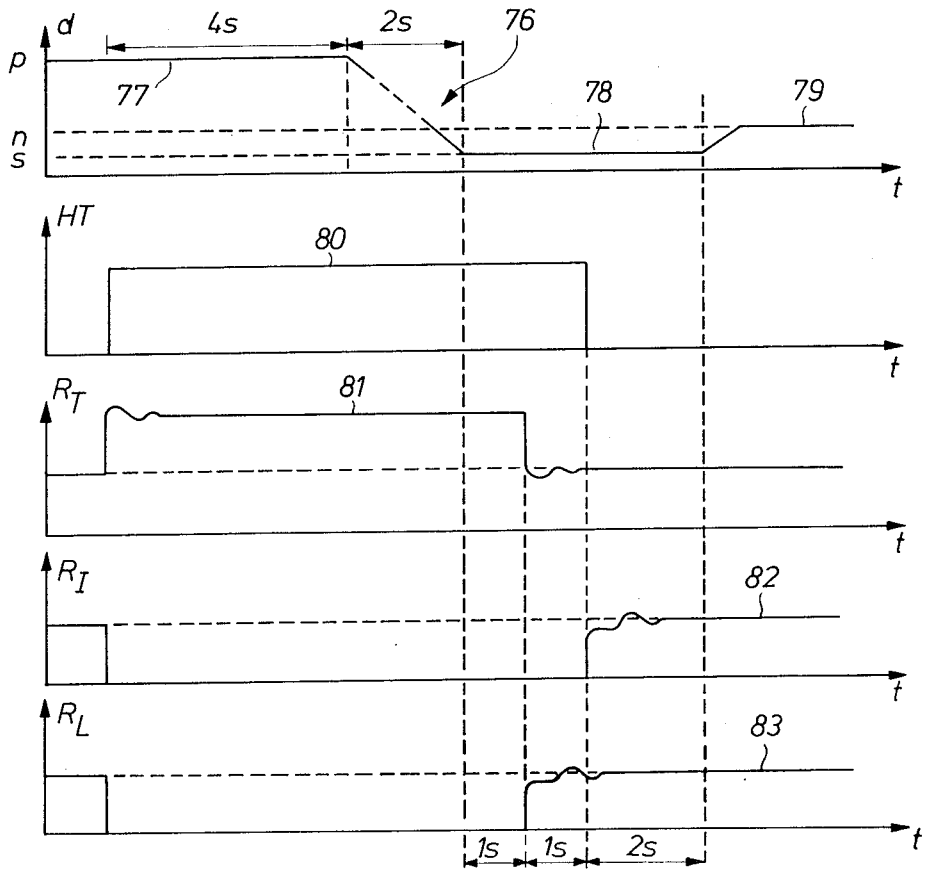
FIG. 7 is a perspective view of a device and apparatus illustrated in FIG. 1 where the ball has been moved to the destination section of the apparatus.
Figure 1:
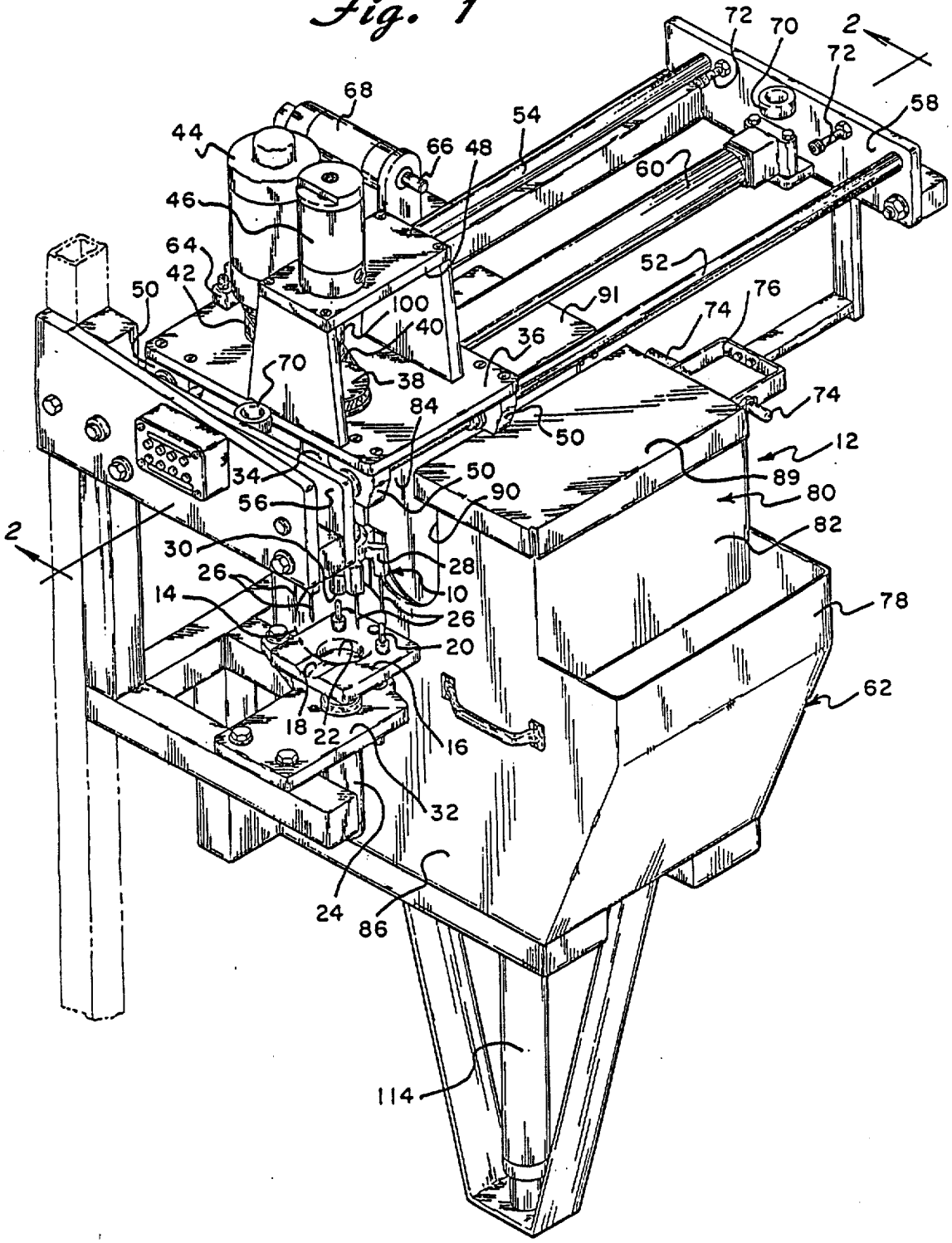
Figure 2:
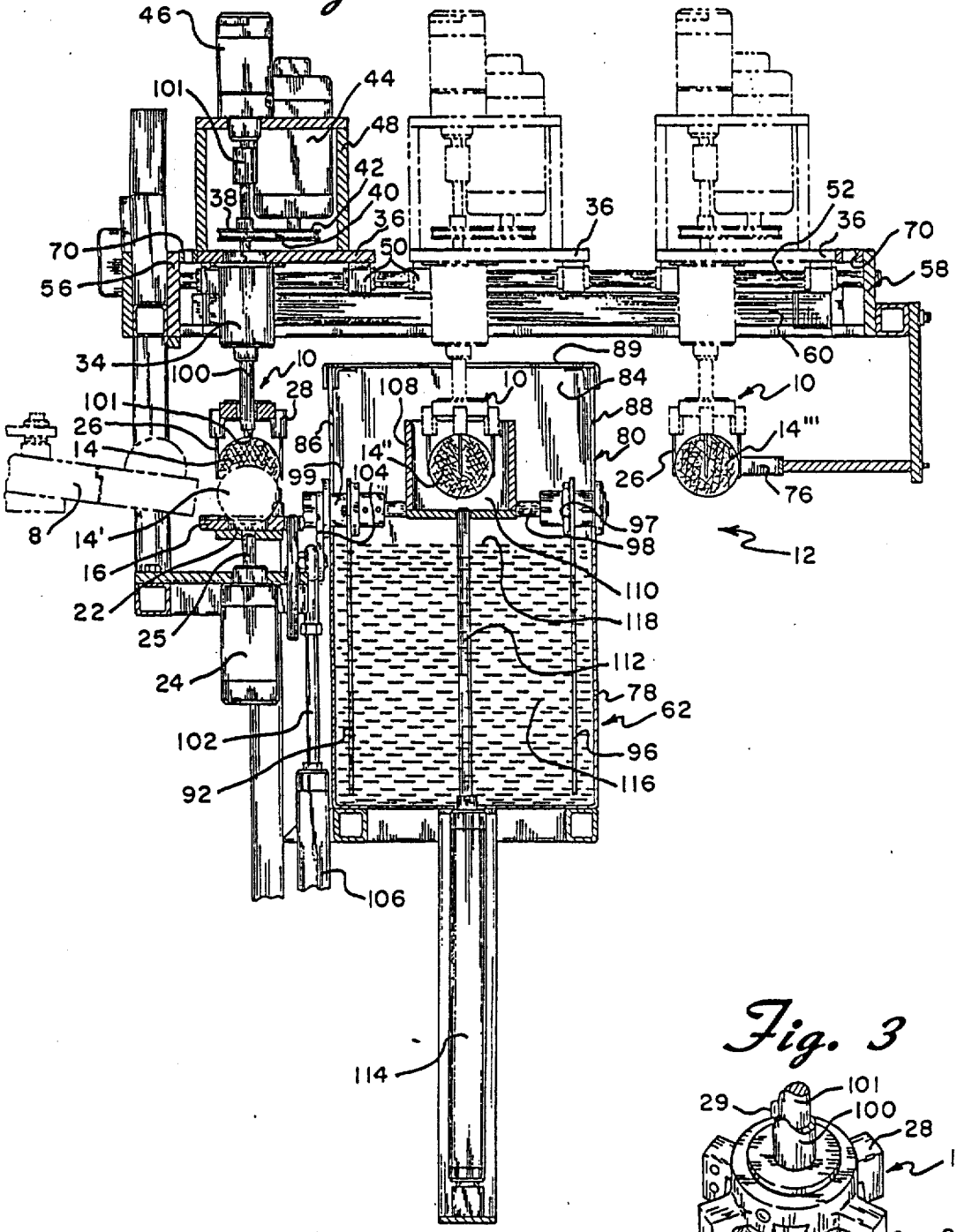
Figure 3:
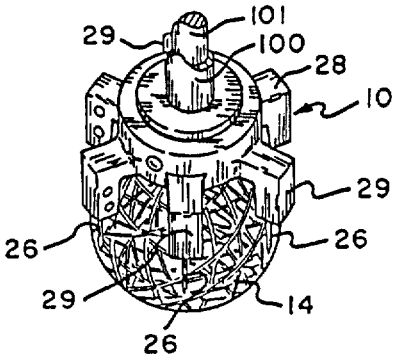
Figure 4:
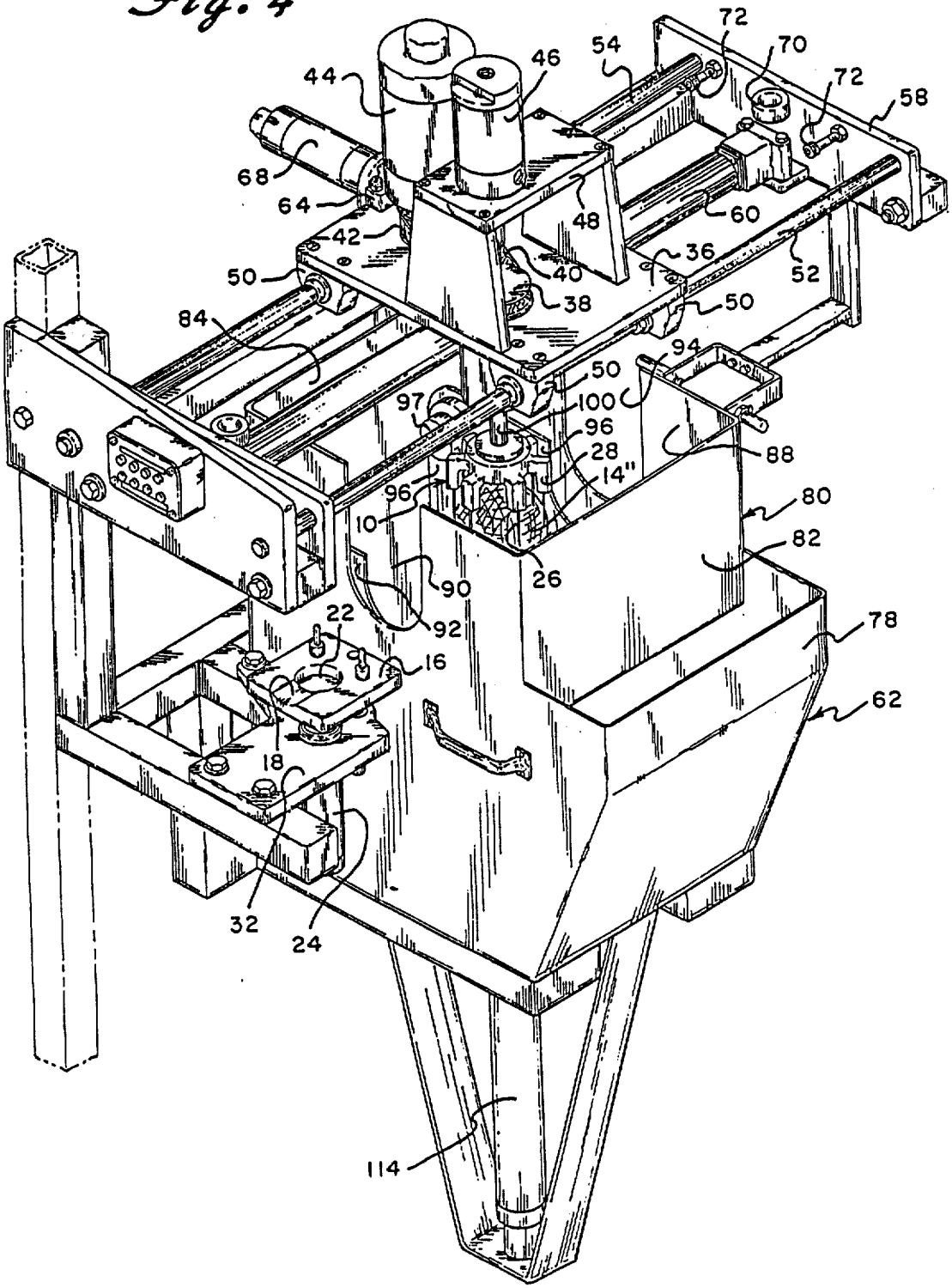
Figure 5:
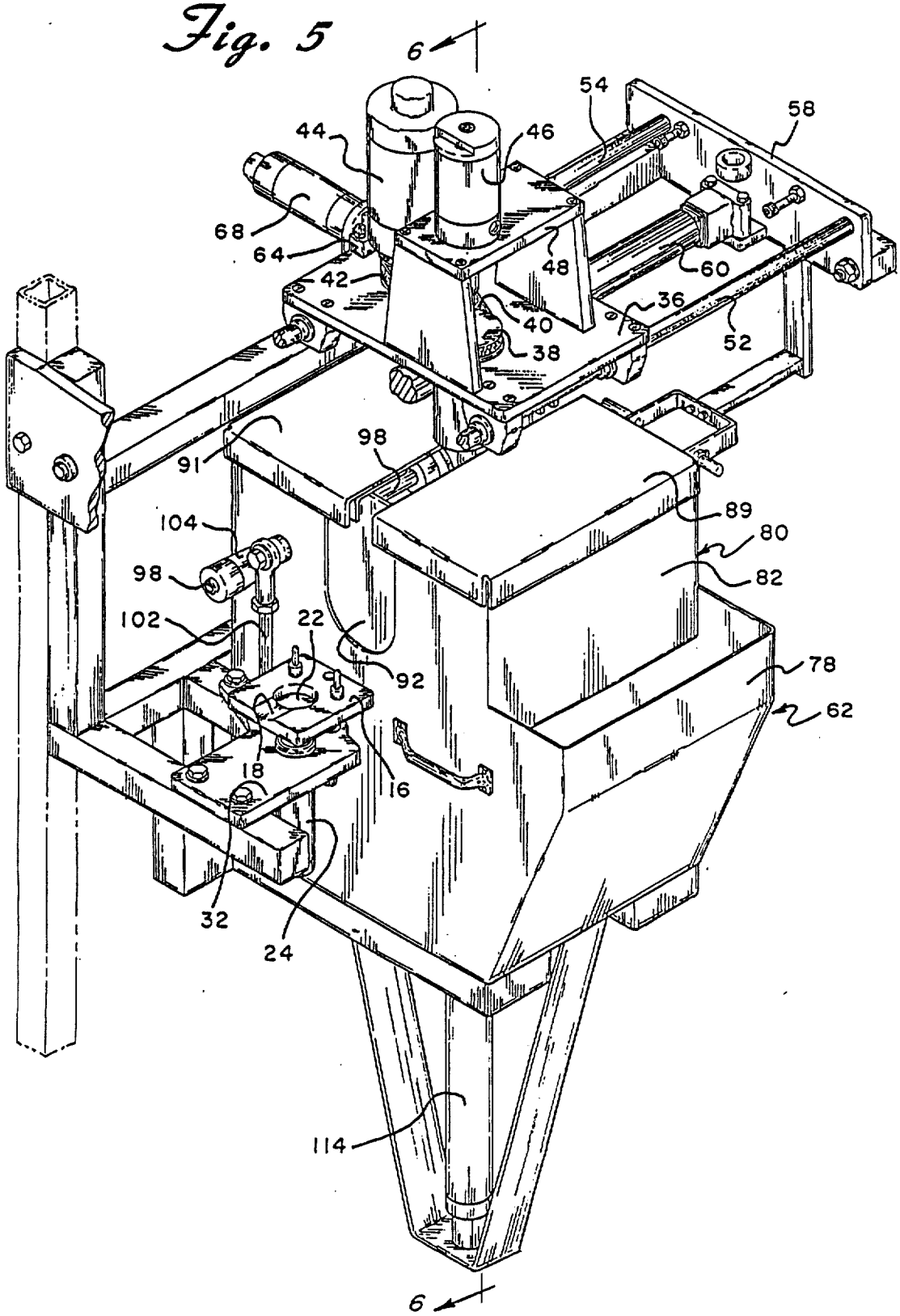
Figure 6:
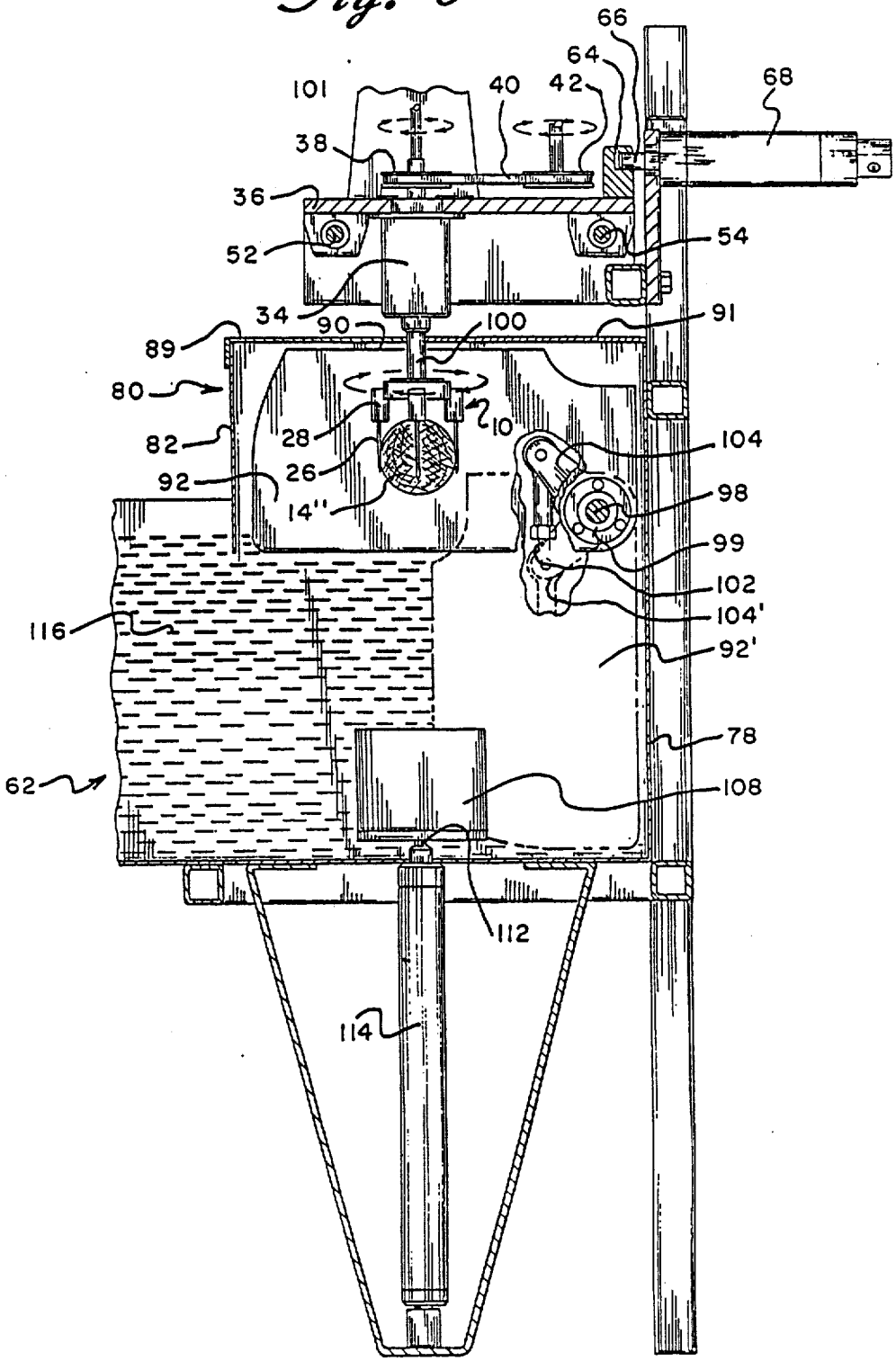
Figure 7:
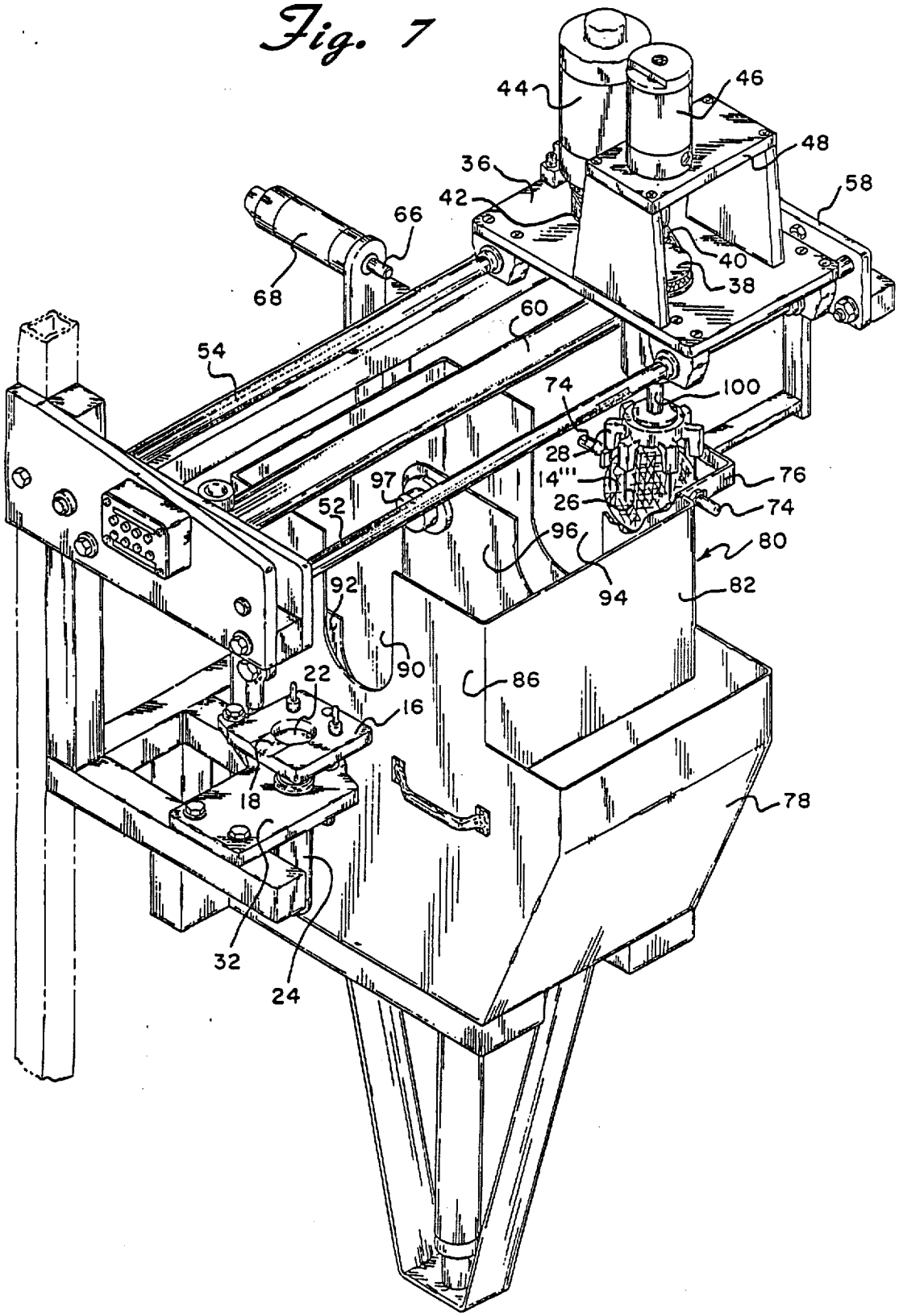

In FIG. 7, platform 36 has been moved to the farthest position at the end of the guide members 52 and 54 resting against the stops extending from support member 58. Ball 14''' is now held by pins 26 extending from base member 28 and is ready to be ejected by air cylinder 46 moving ejector pin 101 downwardly inside shaft 100 to push ball 14 out of engagement between pins 26 and to the destination station. In this view, movable panel 96 is illustrated in its lowered position ready to be raised to protect opening 94 during the next spin cycle While this invention has been described with reference to the specific embodiments disclosed herein, it is not confined to the details set forth and the patent is intended to include modifications and changes which may come within and extend from the following claims.

We claim:

1. A method for holding objects having a cross sectional area of a plane cut through the object and a perifery around the cross sectional area, the method comprising:

(a) supporting a base member, (b) structurally attaching a plurality of at least three tines projecting from the base member with the center line of each of the tines spaced apart on the periphery of an area identical to that of the perifery of the cross sectional area of the object, and (c) wedging the object into the area between the tines so that the sides of the tines firmly hold the object, when the base member is held with the points of the tines pointed downwardly.

2. The method of claim 1 wherein the objects are spherical balls.

3. The method of claim 2 wherein the spherical balls are string wound balls.

4. The method of claim 1 further comprising moving the object vertically upwardly to wedge the object in downwardly depending tines.

5. The method of claim 1 wherein there are six tines on the perifery of the area.

6. The method of claim 1 further comprising:

(a) supporting the object in a set position, and (b) moving the object while supporting the object in the set position, toward the tines to wedge the object between the tines.

7. The method of claim 6 wherein the object is supported in a ring of sufficient size to allow the object to seat in the set position.

8. The method of claim 1, wherein the number of tines is four to ten, all on the perifery of the area.

9. The method of claim 1 further comprising slidably connecting an ejector member extending to the base member in the same direction as the tines to move in a direction away from the object as the object is wedged between the tines.

10. The method of claim 9 further comprising moving the ejector member against the object to dislodge the object from between the tines.

11. A holder for objects comprising:

(a) a base member, (b) a plurality of at least three tines structurally attached and projecting from the base member spaced apart around a periphery of a cross sectional area of a plane cut through the object, the tines being of sufficient size and composition that the object can be forced into the area between the tines, (c) an object support means to support the object in a set position, (d) a support movement means to move the object support means toward the tines to wedge the object between the tines comprising a vertical piston rod attached to the object support means and rod movement means to move the object support means upwardly to wedge the object in downwardly depending tines, (e) an ejector member extending from the base member in the same direction as the tines slidably connected to the base member to move in a direction away from the object as it is wedged between the tines, and (f) an ejector member movement means to move the ejector member against the object to dislodge it from between the tines.

12. A method to coat an object with a liquid comprising:

(a) filling a tank with a supply of the coating liquid with a surface, (b) enclosing a space over the liquid surface with an enclosure comprising first and second vertical walls with interior surfaces, (c) providing a pair of openings through the first and second vertical walls of sufficient size to allow the object holding means and the object it is holding to pass through, into and out of the space, (d) holding a pair of vertical panels at least as large in size as the openings and positioning them to abut the interior surfaces of the first and second walls, (e) raising and lowering the panels a sufficient distance to allow the object holding means and the object to be moved in and out of the enclosure means, (f) holding the object to a carriage body, (g) moving the carriage body along a path to a position over the liquid surface, (h) providing a container having a top opening of sufficient size to allow the object pass through and an internal height of a distance greater than the height of the object as it is held in the object holding means, (i) submerging the container in the liquid, and (j) moving the container upwardly to immerse the object in the liquid in the container.

13. The method of claim 12 further comprising spinning the object in the space over the liquid surface at sufficient rate of rotation to remove any excess liquid from the object.

14. An apparatus to coat an object with a liquid comprising:

(a) a carriage body, (b) object holding means attached to the carriage body to hold the object, (c) a tank containing a supply of coating liquid with a surface, (d) a track movement means to move the carriage body along a path to a position over the liquid surface, (e) an enclosure means to enclose a space over the liquid surface comprising first and second vertical walls interior surfaces, (f) a pair of openings through the first and second vertical walls of sufficient size to allow the object holding means and the object it is holding to pass through into and out of the space, (g) a pair of vertical panels at least as large in size as the openings and positioned to abut the interior surfaces of the first and second walls, (h) panel movement means to support, raise, and lower the panels a sufficient distance to allow the object holding means and the object to be moved in and out of the enclosure means, and (i) coating means to coat the objects with the liquid from the tank.

15. The apparatus of claim 14 further comprising a spinning means to spin the object holding means in the space over the liquid surface at sufficient rate of rotation to remove any excess liquid from the object.

16. The apparatus of claim 14 further comprising:

(a) a container having a top opening of sufficient size to allow the object pass through and an internal height of distance greater than the height of the object as it is held in the object holding means, and (b) a container movement means to submerge the container in the liquid and move the container upwardly to immerse the object in the liquid in the container.

17. The apparatus of claim 21 wherein the object holding means comprises:

(a) a base member, and (b) a plurality of at least three tines structurally attached and projecting from the base member spaced apart around a periphery of a cross sectional area of a plane cut through the object, the tines being of sufficient size and composition that the object can be forced into the area between the tines.

18. An apparatus to coat an object with a liquid comprising:

(a) a tank containing a supply of the coating liquid with a surface, (b) an enclosure means to enclose a space over the liquid surface comprising first and second vertical walls with interior surfaces, (c) a pair of openings through the first and second vertical walls of sufficient size to allow the object holding means and the object it is holding to pass through into and out of the space, (d) a pair of vertical panels at least as large in size as the openings and positioned to abut the interior surfaces of the first and second walls, (e) panel movement means to support, raise, and lower the panels a sufficient distance to allow the object holding means and the object to be moved in and out of the enclosure means, (f) a carriage body on a track movement means to move the carriage body along a path to a position over the liquid surface, (g) an object holding means attached to the carriage body to hold the object over the surface of the liquid, (h) a container having a top opening of sufficient size to allow the object pass through and an internal height of a distance greater than the height of the object as it is held in the object holding means, and (i) a container movement means to submerge the container in the liquid and move the container upwardly to immerse the object in the liquid in the container.

19. The apparatus of claim 18 further comprising a spinning means to spin the object holding means in the space over the liquid surface at sufficient rate of rotation to remove any excess liquid from the object.

20. A method to coat an object with a liquid comprising:

(a) holding an object to a carriage body, (b) filling a tank with a supply of coating liquid with a surface, (c) moving the carriage body along a path to a position over the liquid surface, (d) enclosing a space over the liquid surface with an enclosure comprising first and second vertical walls with interior surfaces, (e) providing a pair of openings through the first and second vertical walls of sufficient size to allow the object holding means and the object it is holding to pass through, into and out of the space, (f) holding a pair of vertical panels at least as large in size as the openings and positioning them at abut the interior surfaces of the first and second walls, and (g) raising and lowering the panels a sufficient distance to allow the object holding means and the object to be moved in and out of the enclosure means, and (h) coating the object with the liquid from the tank.

21. The method of claim 20 further comprising spinning the object in the space over the liquid surface at sufficient rate of rotation to remove any excess liquid from the object.

22. The method of claim 20 further comprising:

(a) providing a container having a top opening of sufficient size to allow the object pass through and an internal height of distance greater than the height of the object as it is held above the liquid surface, and (b) submerging the container in the liquid, and (c) moving the container upwardly to immerse the object in the liquid in the container.

23. The method of claim 20 wherein holding the object comprises:

(a) supporting a base member on the carriage body, (b) structurally attaching a plurality of at least three tines projecting from the base member spaced apart around a periphery of a cross sectional area of a plane cut through the object, and (c) wedging the object into the area between the tines.

* * * * *

UNITED STATES PATENT AND TRADEMARK OFFICE

CERTIFICATE OF CORRECTION

PATENT NO. : 4,877,655

DATED : October 31, 1989

INVENTOR(S) : Rockerath, et al

It is certified that error appears in the above-identified patent and that said Letters Patent is hereby corrected as shown below:

Title page showing the illustrative figures should be deleted to appear as per attached title page.

All Figures 1 through 7 are deleted and replaced by new Figures 1 through 7.

Signed and Sealed this

Twentieth Day of November, 1990

*Attest:*

HARRY F. MANBECK, JR.

*Attesting Officer*

*Commissioner of Patents and Trademarks*

United States Patent [19]

Rockerath et al.

[11] Patent Number: 4,877,655

[45] Date of Patent: Oct. 31, 1989

[54] BALL HOLDING AND CEMENTING APPARATUS AND METHOD

[75] Inventors: John L. Rockerath, Whitesboro, N.Y.; Dale K. Blust, Atco, N.J.

[73] Assignee: Figgie International Inc., Willoughby, Ohio

[21] Appl. No.: 73,819

[22] Filed: Jul. 15, 1987

[51] Int. Cl.[4] ..... B05D 1/18

[52] U.S. Cl. ..... 427/430.1; 118/421; 118/423; 118/428; 118/500; 118/502; 414/626

[58] Field of Search ..... 294/902, 166; 224/919; 118/500, 502, 428, 421, 423; 427/430.1; 414/626

[56] References Cited

U.S. PATENT DOCUMENTS

| | | | |
|---|---|---|---|
| 229,544 | 7/1880 | Maynard | 118/502 |
| 309,243 | 12/1884 | Patch | 118/502 |
| 1,238,619 | 8/1917 | Anderson | 118/56 |
| 1,258,071 | 3/1918 | Winter | 118/421 X |
| 1,327,273 | 1/1920 | Eskilson | 118/52 |
| 1,333,006 | 3/1920 | Welser | 198/377 |
| 1,366,188 | 1/1921 | Kirino . | |
| 1,608,293 | 11/1926 | Beebe | 118/502 |
| 1,622,855 | 3/1927 | Warner | 118/56 |
| 1,714,994 | 5/1929 | Turner . | |
| 1,733,192 | 10/1929 | Haber | 134/61 |
| 1,796,820 | 3/1931 | Adams | 118/54 |
| 1,840,008 | 1/1932 | Ault | 156/538 |
| 1,961,301 | 6/1934 | Nier | 91/42 |
| 2,120,171 | 6/1938 | Bialy | 20/70 |
| 2,122,052 | 6/1938 | Bell | 198/199 |
| 2,556,744 | 6/1951 | Walrath | 118/503 |
| 2,615,455 | 10/1952 | Persson | 134/58 |
| 2,647,282 | 8/1953 | Schroeder | 18/27 |
| 2,667,138 | 1/1954 | Maher | 113/93 |
| 2,695,595 | 11/1954 | Hagerman | 118/502 |
| 2,822,843 | 2/1958 | Morici | 146/52 |
| 2,857,878 | 10/1958 | Matson et al. | 118/421 |
| 2,864,281 | 12/1958 | Draper | 88/14.8 |
| 2,884,897 | 5/1959 | Richeson | 118/315 |
| 2,958,308 | 11/1960 | Pikal | 118/16 |
| 3,147,847 | 9/1964 | Miller | 198/131 |
| 3,310,027 | 3/1967 | Lindemann | 118/52 |
| 3,374,903 | 3/1968 | Glover | 214/6 |
| 3,447,707 | 6/1969 | Furst | 214/307 |
| 3,633,540 | 1/1972 | Bolt | 118/502 |
| 3,827,400 | 8/1974 | Grenfell | 118/421 |
| 3,830,152 | 8/1974 | Reed | 99/643 |
| 3,847,070 | 11/1974 | Draggett | 99/643 |
| 4,072,256 | 2/1978 | Young | 294/166 X |
| 4,096,295 | 6/1978 | Marks | 427/209 |
| 4,113,165 | 9/1978 | Ott | 118/421 X |
| 4,314,524 | 2/1982 | Deguchi | 118/54 |
| 4,597,931 | 7/1986 | Watanabe et al. | 118/421 X |

*Primary Examiner*—Shrive Beck

*Attorney, Agent, or Firm*—Thomas A. Lennox

[57] ABSTRACT

A holder and cementing apparatus for string wound baseball cores includes six vertically downwardly depending tines arranged in a circular pattern to allow the ball to be wedged between the tines with an ejector pin moved upwardly by engagement of the ball and later forced downwardly to eject the ball with the holder supported on a trolley moving along horizontal guides from a first station where the ball is pushed upwardly by a supporting member into the ball holder to a second position inside an enclosure over a coating liquid supply where a cup is raised from below the level of the liquid to immerse the ball in the cup's liquid with movable side panels that open and close to allow the ball to enter the enclosure and to protect from liquid splatter when the ball is rotated at a high rate of speed to remove excess liquid followed by movement out of these openings to a destination station where a ball is sensed to insure proper operation.

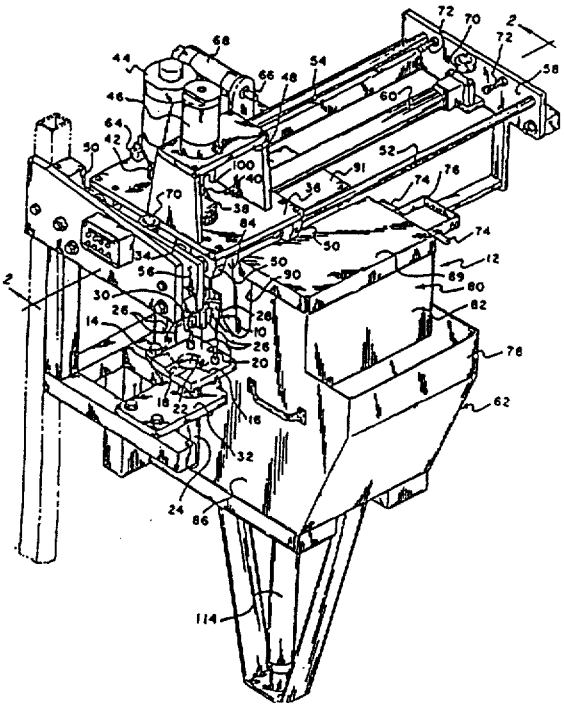

23 Claims, 6 Drawing Sheets